United States Patent [19]

Olsson

[11] Patent Number: 5,050,704

[45] Date of Patent: Sep. 24, 1991

[54] HARNESS FOR A SAFETY LINE

[75] Inventor: Ronny Olsson, Bollnäs, Sweden

[73] Assignee: Sala Equip AB, Sala, Sweden

[21] Appl. No.: 585,061

[22] PCT Filed: Apr. 14, 1989

[86] PCT No.: PCT/SE89/00207

§ 371 Date: Oct. 19, 1990

§ 102(e) Date: Oct. 19, 1990

[87] PCT Pub. No.: WO89/10160

PCT Pub. Date: Nov. 2, 1989

[30] Foreign Application Priority Data

Apr. 20, 1988 [SE] Sweden ..... 8801454

[51] Int. Cl.[5] ..... A62B 35/00

[52] U.S. Cl. ..... 182/9; 182/135

[58] Field of Search ..... 182/9, 8, 3, 4, 135

[56] References Cited

U.S. PATENT DOCUMENTS

| | | | |
|---|---|---|---|
| 2,796,953 | 6/1957 | Becker | 182/4 |
| 2,834,525 | 5/1958 | Shawgo | 182/9 |
| 3,840,091 | 10/1974 | Conlon | 182/9 |
| 4,712,646 | 12/1987 | Page | 182/9 |

*Primary Examiner*—Reinaldo P. Machado

*Attorney, Agent, or Firm*—Birch, Stewart, Kolasch & Birch

[57] ABSTRACT

A harness for use with a safety line utilized in climbing a pole or the like. The harness includes two shoulder straps with each strap having located therealong a fastening device for the safety line. Each fastening device is movable along a guide associated with its respective shoulder strap and is resiliently positioned in order to yieldingly counteract the movement of each fastening device along its guide.

4 Claims, 2 Drawing Sheets

HARNESS FOR A SAFETY LINE

TECHNICAL FIELD OF THE INVENTION

This invention relates to a harness for a safety line of the type which is intended to hold a person climbing a pole or the like, while allowing him to have his hands free, comprising two suitably loop-shaped fastening means for the safety line which are each arranged along a shoulder strap of the harness, whereby tensile stresses applied to said fastening means from the safety line are distributed to the harness via said shoulder straps.

BACKGROUND OF THE INVENTION

In connection with mounting or repair work on such poles as telephone poles or power-line pylons, the operator uses not only a pair of climbing irons, but also a safety line which can be passed around the pole for retaining the operator in an obliquely rearwardly-upwardly inclined position in which he has his hands free for manipulating the tools and the wiring equipment required for carrying out the work. Traditionally, the safety line is fastened to a simple belt strapped around the operator's waist. More specifically, this is done by fastening safety hooks mounted on the safety line, in loops or rings mounted on the front portion of the belt. A serious drawback of this arrangement however is that the load exerted by the weight of the operator must be taken up by the relatively narrow belt which supports only the lower part of the operator's back, but leaves the other parts of the back without any support whatsoever. In practice, this means that the spine of the operator is subjected to extreme stresses in the area of the lumbar vertebrae, with serious, often irrepairable wear of the vertebrae as a result.

To overcome the problems stated above, it is desirable to apply the fastening means for the safety line to a harness having shoulder straps which, far more efficiently than a simple belt, can distribute the stresses over the operator's body. Such a harness is previously known from AT 383,493, but in this prior art harness, the fastening means are fixedly mounted on the pertaining shoulder strap in a position given once and for all. This means that the operator nevertheless will be subjected to stresses concentrated in certain points of his body and resulting in that the harness straps will be tightened abruptly and with a pull when he leans backwards. This occurs in a predetermined rear end position from which the operator cannot lean further backwards. In practice, the operator will thus find the harness uncomfortable and too tight-fitting.

SUMMARY OF THE INVENTION

The present invention aims at further developing the known harness such that it becomes comfortable and easy to use in practice. According to the invention, this is achieved in that each fastening means is movable along a guide associated with the pertaining shoulder strap and acted on by one or more resilient means yieldingly counteracting the movements of the fastening means along said guide.

DETAILED DESCRIPTION OF PREFERRED EMBODIMENTS OF THE INVENTION

Figure 1:
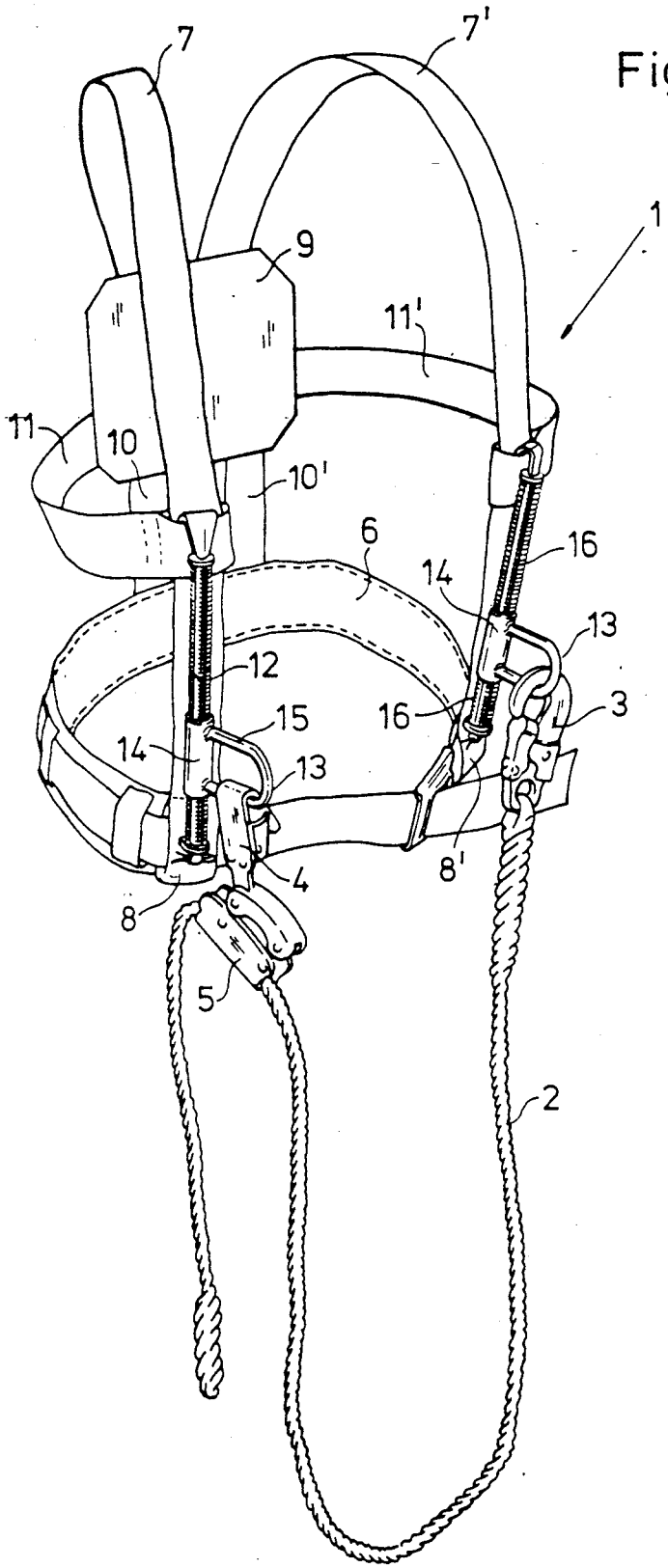
FIG. 1 is a perspective view of a first embodiment of the inventive harness with a pertaining safety line.

In FIG. 1, the inventive harness is generally designated 1, while 2 designates a safety line which in conventional manner comprises both stationary hook means 3 and movable hook means 4 which can be locked in the desired position along the line 2 by means of a locking mechanism 5.

In addition to a waist belt 6, the harness 1 has two shoulder straps 7,7' which are connected at their front ends to the front portion of the waist belt 6. Suitably, this connection is brought about by means of loops 8,8' which allow a certain displacement or adjustment of the shoulder straps along the waist belt. At their rear ends, the shoulder straps 7,7' are connected to a support plate 9, in turn connected to the rear portion of the waist belt 6 by means of two comparatively short connecting straps 10,10'. These connecting straps may either be separate straps which at opposite ends are fixed or connected to the support plate and the waist belt, or be parts of the shoulder straps 7,7', the support plate 9 being connected to the straps in a suitable manner and optionally being displaceable along them. Spaced from the waist belt 6 and substantially parallel to it, there are further provided side straps 11,11' extending from the rear support plate 9 to the front portions of the shoulder straps 7,7'.

In the illustrated example, each of the shoulder straps 7,7' is provided with a rod-shaped or tubular element 12 serving as a guide for a fastening means generally designated 13 and consisting of a tubular member 14 movable back and forth along the rod-shaped element, and of a loop or ring 15 which is fixed to the tubular member and in which the respective hook 3, 4 can be fastened. There are further provided, both above and below the tubular member 14, helical compression springs 16 surrounding the rod-shaped element and yieldingly counteracting the movements of the tubular member along the rod-shaped element. In practive, it may be advantageous to provide a plurality of relatively short springs on each side of the tubular member or fastening means, it being possible to shift the individual springs from a position above the fastening means to a position below it, and vice versa. In this manner, the fastening means can be placed in different, individually selectable initial positions adapted to the bearer of the harness.

Figure 2:
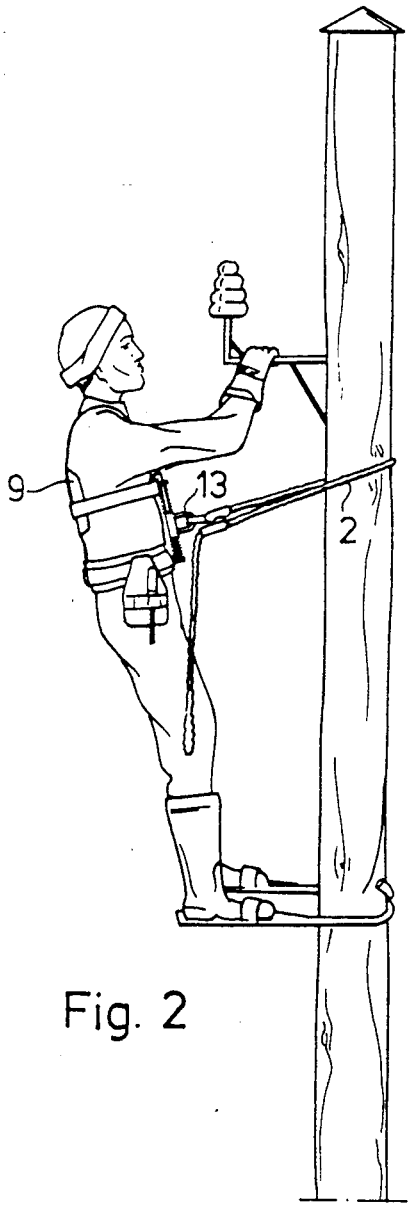
FIG. 2 is a schematic side view showing the use of the harness in connection with pole climbing.
Figure 3:
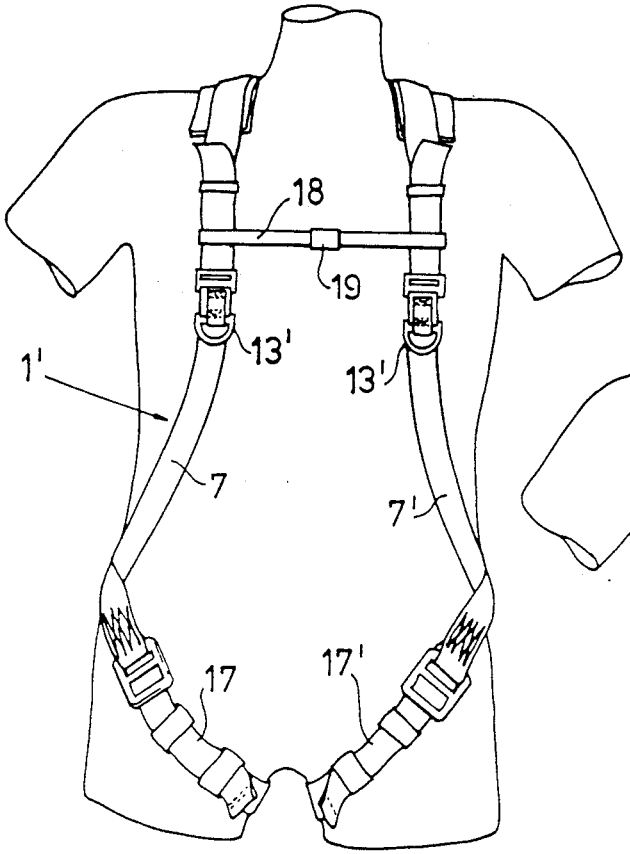
FIG. 3 is a front view of a further developed embodiment of the inventive harness.
Figure 4:
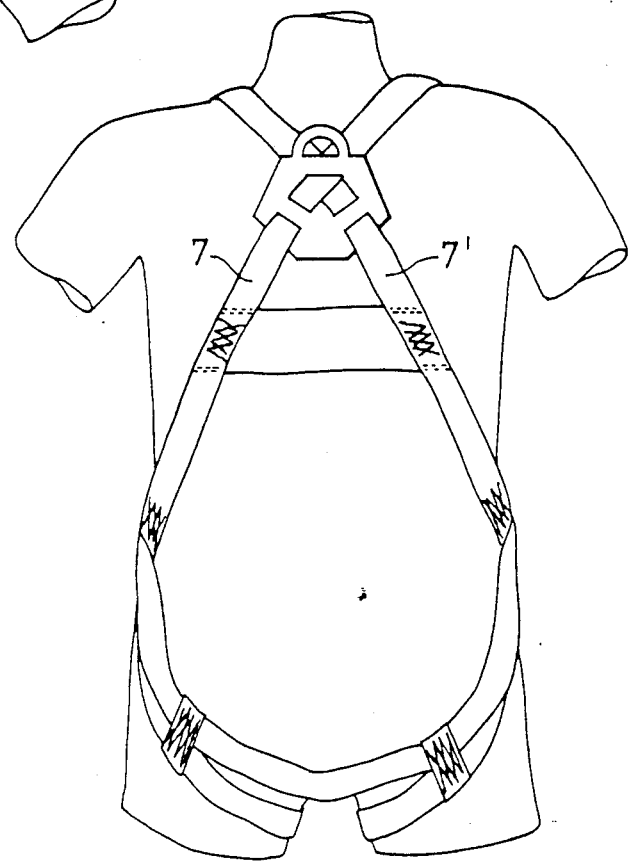
FIG. 4 is a rear view of the harness according to FIG. 3, and FIGS. 5 and 6 are detailed views showing a fastening means in two different states of operation.

The operation and advantages of the inventive harness are obvious. When the safetly line is held placed around a pole as shown in FIG. 2, the tensile stresses applied to the line by the operator leaning backwards will be transmitted to the two fastening means 13 which by their cooperation with the upper and lower springs 16 on the guide elements will be displaced by gently resilient motions without giving rise to any jerky tightening of the harness straps. By the resilient mounting of the fastening means, the operator will find the harness comfortable and easy to work in. When the operator leans backwards, the lower springs will be progressively compressed, giving however the operator full freedom of movement, not only forwards but also backwards as long as the lower springs have not been completely compressed. In other words, the springs will obviate the occurrence of an unresilient end position, which is found in the known harness where the fastening means are fixedly mounted on the shoulder straps.

Reference is now made to FIGS. 3–6 illustrating a harness 1' without a particular waist belt. Thus, this harness comprises two shoulder straps crossing each other on the operator's back and placed in loops 17,17' passing around the legs of the operator. On the operator's chest, the two straps 7,7' are held together by a cross-strap 18 slidable along these straps and having a buckle 19 dividing the cross-strap into two pieces.

Figure 6:
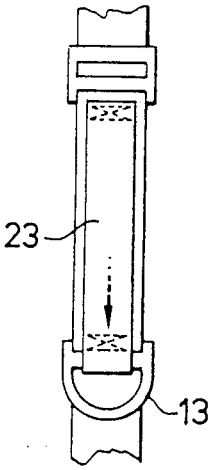
Figure 5:
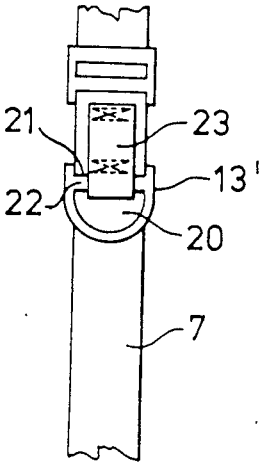

In the illustrated embodiment, the fastening means 13' consists of a plate or plate-shaped member having two holes 20,21, the first 20 of which serves to receive either of the hook means 3,4 of the safety line 2. The other hole 21 serves as a passage for the pertaining shoulder strap 7. In this case, the shoulder strap 7 itself serves as the guide along which the fastening means is movable. To the intermediate part 22 located between the holes 20 and 21 is fixed one end of an elastic band 23, especially a reinforced rubber band, which serves as spring means for the fastening means 13' and the opposite end of which is fixed to the shoulder strap, either directly to the shoulder strap via a seam or by means of a fitting which is adjustable in different positions relative to the strap. FIG. 5 shows the spring means or band 23 in an untensioned state, while FIG. 6 shows the same band in an extended or stretched state which arises when the operator leans backwards. In practice, the elastically yielding band 23 may be so conceived as to allow the fastening means 13' to move at least about 200 mm from the initial position shown in FIG. 5 to a maximally-stretched state. Although, in this case, it is preferred to connect the fastening means to a single elastic band which can be stretched and serves as a tension spring, it is also conceivable on the opposite side, i.e. the lower side of the fastening means, to provide a second elastic band which, together with the upper elastic band, can hold the fastening means in an initial position from which it can move both upwards and downwards against the action of the respective rubber band.

CONCEIVABLE MODIFICATIONS OF THE INVENTION

It goes without saying that the invention is not restricted only to the embodiments described above and illustrated in the drawings. Thus, it is conceivable, for instance, to provide the harness shown in FIGS. 3 and 4 with loops or fittings which allow applying a special waist belt designed as ancillary equipment, supplementing the harness when the operator so desires. Further, the design of the fastening means 13, 13' may of course vary within wide limits, like the design of the spring means, whether these are compression springs or tension springs

I claim:

1. A harness for a safety line of the type which is intended to hold a person climbing a pole or the like, while allowing him to have his hands free, comprising two fastening means (13,13') for the safety line (2) which are each arranged along a shoulder strap (7,7') of the harness, whereby tensile stresses applied to said fastening means from the safety line are distributed to the harness via said shoulder straps, characterised in that each fastening means (13,13') is movable along a guide (12;7,7') associated with the pertaining shoulder strap and acted on by one or more resilient means (16,23) yieldingly counteracting the movements of the fastening means along said guide.

2. Harness as claimed in claim 1, characterised in that said resilient means consists of an elastic band (23), for instance of rubber.

3. Harness as claimed in claim 1 or 2, characterised in that said fastening means consists of a plate or member (13') having two holes (20,21), one (20) of which serves to receive hook means (3,4) for said safety line (2) and the other (21) of which is traversed by a shoulder strap (7,7') serving as a guide along which said fastening means is movable in its entirety against the action of at least one resilient means (23), especially a rubber band.

4. Harness as claimed in any one of the preceding claims, characterised in that there are provided on opposite sides of said fastening means resilient means (16) which constantly tend to maintain said fastening means in a given initial position along said guide (12) and against the action of which said fastening means is movable from said initial position in either of two opposite directions.

* * * * *